US007303508B2

(12) United States Patent
Toyama et al.

(10) Patent No.: US 7,303,508 B2
(45) Date of Patent: Dec. 4, 2007

(54) TRAINING EQUIPMENT

(75) Inventors: Motoki Toyama, Kobe (JP); Kojiro Minami, Kobe (JP); Eita Kada, Kobe (JP); Hirofumi Nagao, Kobe (JP); Takuya Nakano, Kobe (JP)

(73) Assignee: Konami Sports Life Corporation, Tokyo (JP)

( * ) Notice: Subject to any disclaimer, the term of this patent is extended or adjusted under 35 U.S.C. 154(b) by 340 days.

(21) Appl. No.: 10/527,369

(22) PCT Filed: Sep. 5, 2003

(86) PCT No.: PCT/JP03/11331

§ 371 (c)(1),
(2), (4) Date: Mar. 10, 2005

(87) PCT Pub. No.: WO2004/024241

PCT Pub. Date: Mar. 25, 2004

(65) Prior Publication Data

US 2006/0009329 A1 Jan. 12, 2006

(30) Foreign Application Priority Data

Sep. 13, 2002 (JP) ..... 2002-267813

(51) Int. Cl.
*A63B 22/00* (2006.01)

(52) U.S. Cl. ..... 482/51; 482/123; 482/146

(58) Field of Classification Search ..... 482/51, 482/70, 71, 121–123, 127, 129, 130, 135, 482/146; 434/253
See application file for complete search history.

(56) References Cited

U.S. PATENT DOCUMENTS 3,731,919 A 5/1973 Schurch (Continued)

FOREIGN PATENT DOCUMENTS

JP 43-2391 1/1968

(Continued)

OTHER PUBLICATIONS

Microfilm of the specification and drawings annexed to the request of Japanese Utility Model Application No. 168842/1986 (Laid-open No. 74155/1988) (Shin'ya Ono), May 18, 1988, p. 4, line 19 to p. 5, line 3.

(Continued)

*Primary Examiner*—Jerome Donnelly
*Assistant Examiner*—Tam Nguyen
(74) *Attorney, Agent, or Firm*—Jordan and Hamburg LLP

(57) ABSTRACT

Training apparatus includes: a base stand which has slide shafts that are provided side by side and extend in the right-and-left directions; a slide base portion which can slide along this slide shaft; a foot stand which is provided over the slide base portion so as to be turned; a connection mechanism portion which is formed by a rod and its support portion that engages a substantially-middle proper part of the base stand in the right-and-left directions and the foot stand, so that the sliding position and the turning angle of the foot stand can be correlated; and a spring which gives the slide base portion the force by which the slide base portion moves toward a substantially-middle position of the base stand in the right-and-left directions. Thereby, a sliding exercise and a twisting exercise can be taken together, and the body trunk can be effectively trained.

12 Claims, 13 Drawing Sheets

U.S. PATENT DOCUMENTS

| | | | | |
|---|---|---|---|---|
| 4,607,839 | A * | 8/1986 | Knudson | 482/71 |
| 5,125,880 | A * | 6/1992 | Peters | 482/68 |
| 5,209,711 | A * | 5/1993 | Scrima | 482/70 |
| 5,328,427 | A * | 7/1994 | Sleamaker | 482/71 |
| 6,569,064 | B1 * | 5/2003 | Loane | 482/71 |
| 6,786,850 | B2 * | 9/2004 | Nizamuddin | 482/51 |

FOREIGN PATENT DOCUMENTS

| | | |
|---|---|---|
| JP | 63-74155 | 5/1988 |
| JP | 2001-70473 | 3/2001 |

OTHER PUBLICATIONS

Microfilm of the specification and drawings annexed tot he request of Japanese Utility Model Application No. 163002/1985 (Laid-open No. 72662/1987) (Kawai Musical Inst. Mfg. Co., Ltd.), May 9, 1987, Fig. 5.

* cited by examiner

TRAINING EQUIPMENT

CROSS-REFERENCE TO RELATED DOCUMENTS

This application is a 371 of PCT/JP03/11331 filed on Sep. 5, 2003.

TECHNICAL FIELD

The present invention relates to training apparatus in which a sliding exercise and a twisting exercise can be taken at the same time.

BACKGROUND ART

Conventionally, there is known training apparatus in which a sliding exercise or a twisting exercise can be taken. Such equipment, as shown in FIG. 14A, B, an arch-shaped track 402 is provided in a base 401, and two concentric-circle paths 403, 404 are formed on this track 402. Then, movable stands 405, 406 are provided along the concentric-circle paths 403, 404, so that they can move. To these movable stands 405, 406, a shoe (or foot stand) 407 as the foot stand is attached within the horizontal surface of each movable stand, respectively, so that they can turn. A player can do training, such as skiing, by stepping on the shoes (or foot stands) 407 (i.e., putting his right and left feet thereon) and moving the movable stands 405, 406 along the concentric-circle paths 403, 404 so that he can take a sliding exercise, or by turning the shoes (or foot stands) 407 so that he can take a twisting exercise.

In addition, conventionally, as shown in FIG. 15, there is known equipment in which a first frame 503 which has a cut opening 502 that is long sideways is fixed on a slippery stand 501, a circular second frame 504 which can be turned is provided inside of the opening 502 of this first frame 503, and two circular turn tables 505 which can be turned are provided inside of second frame 504. A player can do training, such as skiing, by putting both his feet on the turn tables 505, and taking a sliding exercise in the right-and-left directions or taking a twisting exercise.

In your daily life or sports scene, you very often have the opportunity of moving your body in an unstable position (or posture). When you try to balance your body in such an unstable state, you frequently have to exert strength not only in your limbs (or arms and legs), but also in your trunk such as abdominal muscle and back muscle. Therefore, when you train yourself, it is important to simultaneously train your limbs as well as your trunk.

However, in the above described prior art, the right and left foot stands are separately moved and turned. Hence, a sliding exercise or a twisting exercise is broken up with each foot.

Furthermore, as conventional equipment, there is known equipment in which right and left foot stands are linked and moved together. However, in this equipment, when you take a sliding exercise or a twisting exercise, you have to make a stamping motion, or make the motion of moving both your feet up and down. Therefore, you tend to lose your body balance and to focus too much on the exercise of exerting strength in your lower limbs (or legs). As a result, there is a disadvantage in that you cannot train your body trunk effectively.

DISCLOSURE OF THE INVENTION

It is an object of the present invention to provide training apparatus in which you can take a sliding exercise and a twisting exercise together without making a stamping motion or another such motion, and train your body trunk effectively.

In order to attain the above described object, training apparatus according to the present invention includes: a base stand which is provided with a guide rail that extends in the right-and-left directions; a slide base portion which can slide along the guide rail; a foot stand which is provided over the slide base portion so as to be turned; a connection means which engages the base with the foot stand at a substantially-middle suitable place of the base stand in the right-and-left directions, so that the sliding position of the foot stand can be related to the turning angle thereof; and a force giving means which gives the slide base portion the force by which the slide base portion moves toward a substantially-middle position of the base stand in the right-and-left directions.

According to the above described configuration, when the slide base portion is slid in the right-and-left directions along the guide rail, the foot stand over the slide base portion turns, by the provided connection means, at an angle which corresponds to the distance by which it has been slid to the slide base portion. In other words, when the slide base portion makes a sliding motion, the foot stand makes a sliding motion in the direction where it has been slid. In addition, by providing the force giving means for generating restoring force, the foot stand which has slid in the right-and-left directions returns automatically to the neutral position of the middle part in the longitudinal directions of the guide rail, and a proper load which is preferred for training is produced when it is slid in the right-and-left directions. A player can take a sliding exercise and a twisting exercise at the same time, without losing his body balance in a state of keeping both his feet on the foot stand. This allows you to train your body trunk effectively.

BEST MODE FOR IMPLEMENTING THE INVENTION

Figure 1:
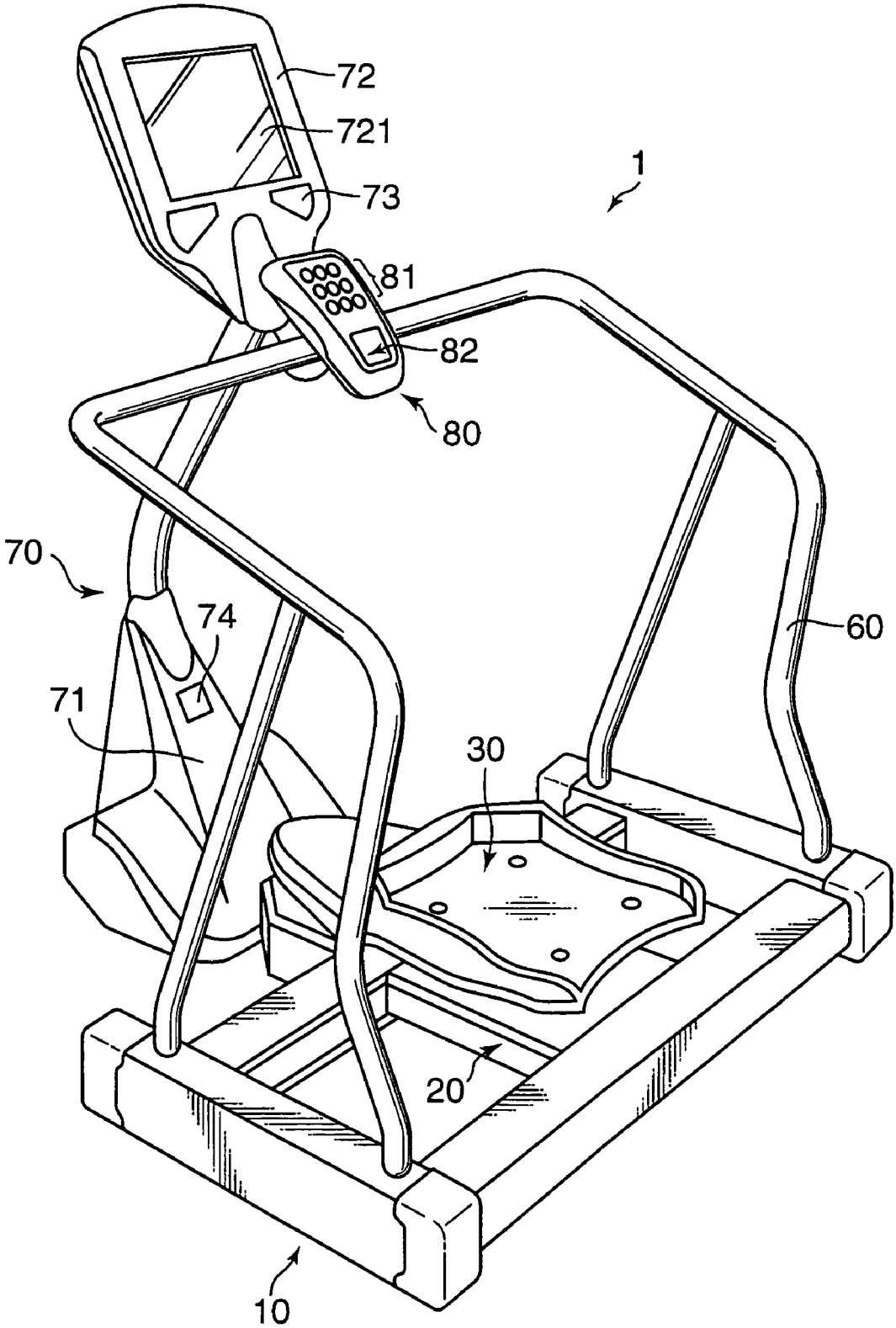
FIG. 1 is a perspective view of training apparatus according to an embodiment of the present invention, showing its external appearance.
Figure 2A:
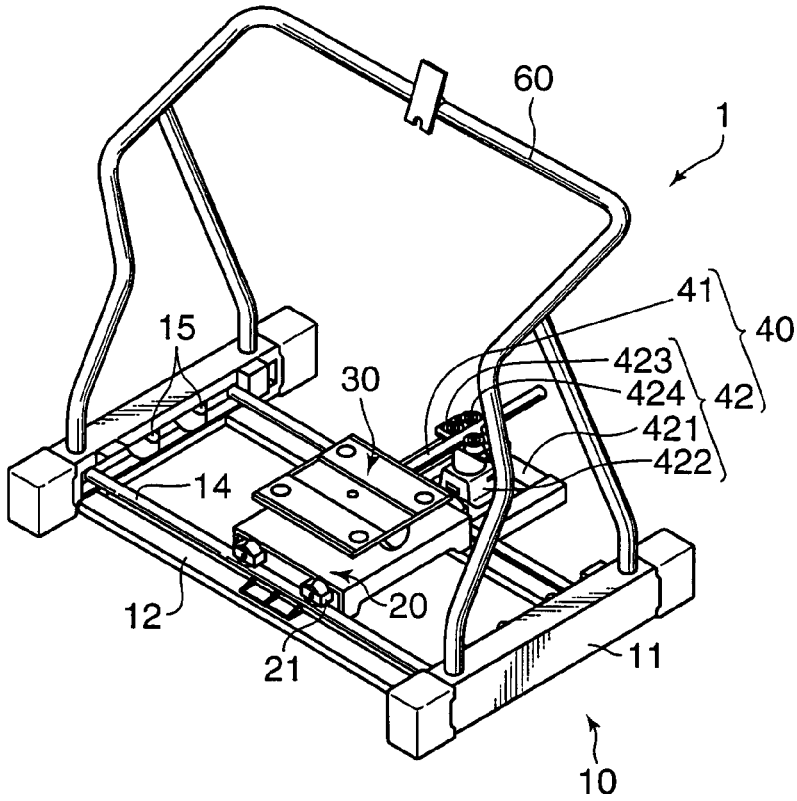
FIG. 2A is a perspective view of the training apparatus of FIG. 1 whose covers are removed, seen from the back, showing its structure.
Figure 2B:
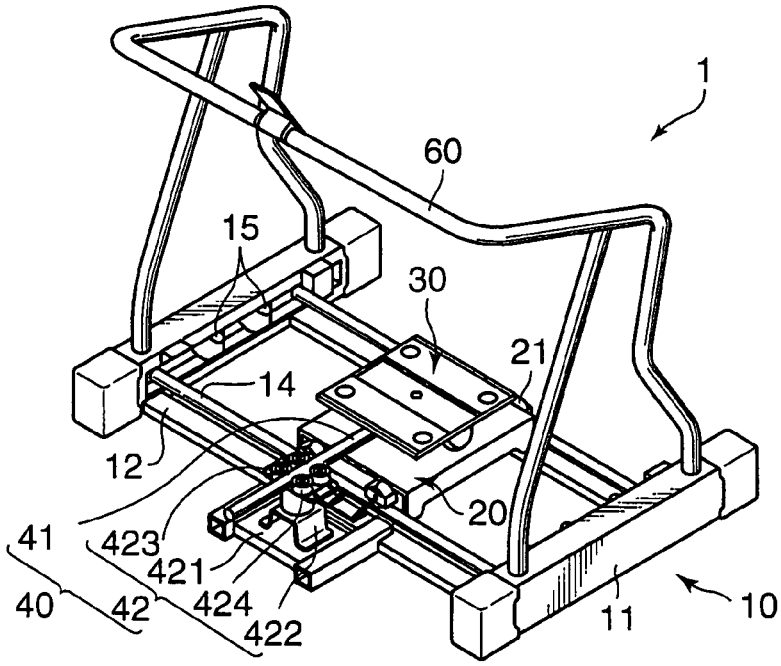
FIG. 2B is a perspective view of the training apparatus of FIG. 1 whose covers are removed, seen from the front, showing its structure.
Figure 3A:
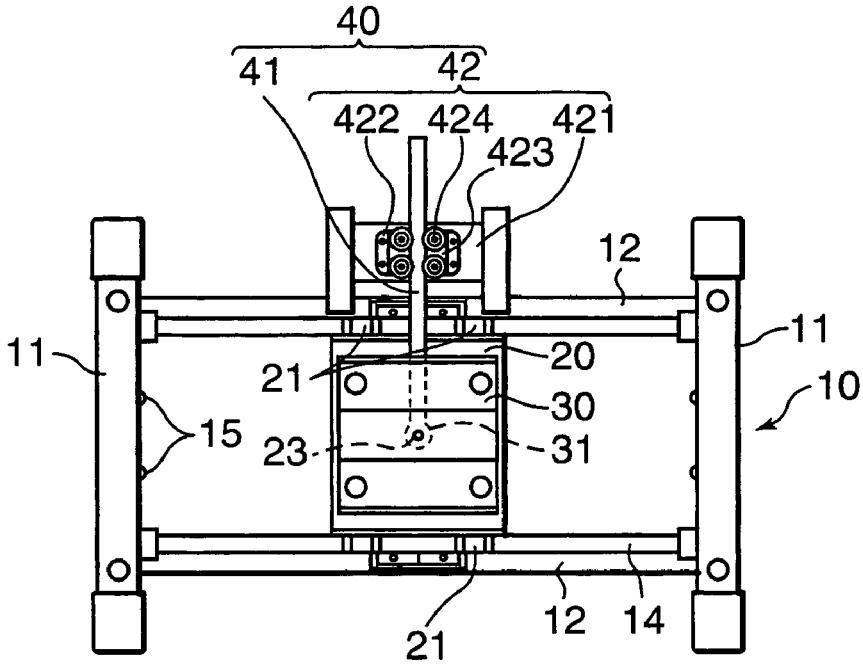
FIG. 3A is a top plan view of the training apparatus of FIG. 2 whose foot-stand portion is not slid.
Figure 3B:
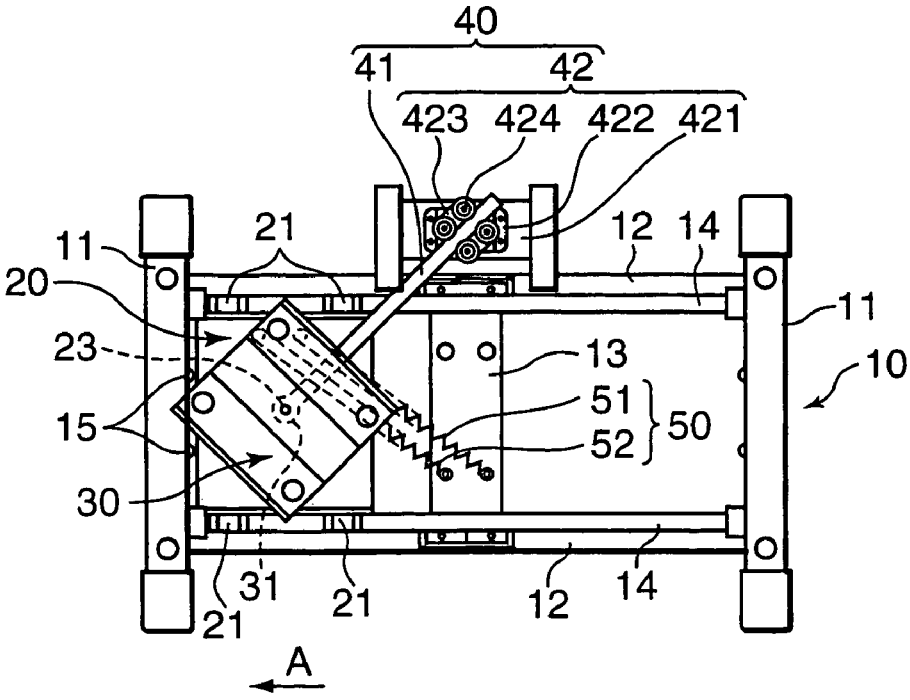
FIG. 3B is a top plan view of the training apparatus of FIG. 2 whose foot-stand portion is kept slid.

FIG. 1 is a perspective view of training apparatus according to an embodiment of the present invention, showing its external appearance. FIG. 2 shows the structure of the training apparatus of FIG. 1 whose covers are removed. FIG. 2A is its perspective view, seen from the back, and FIG. 2B is its perspective view, seen from the front. FIG. 3 is a plan view of FIG. 2. FIG. 3A shows a state in which a foot-stand portion is not slid, and FIG. 3B shows a state in which the foot-stand portion is kept slid.

As shown in FIG. 1 to FIG. 3, this training apparatus 1 includes: a base stand 10; a slide base portion 20; a foot-stand portion 30 (or the foot stand); a connection mechanism portion 40 (or the connection means); a force giving portion 50 (or the force giving means); and in addition, a handrail portion 60; a guide portion 70; a controller 80.

In FIG. 1, this training apparatus 1 includes the slide base portion 20 which can be slid right and left with respect to the base stand 10, and the foot-stand portion 30 which can be turned over this slide base portion 20. It is configured so that a player gets on this foot-stand portion 30 and can freely move his body's lower half right and left. The handrail portion 60 helps a training player easily exercise by holding this handrail portion 60. The guide portion 70 offers a player an image or the like for a training guide as a conductor. The controller 80 is configured so that a player can operate it, and is used to input the selection of a training mode or other required contents.

Figure 4:
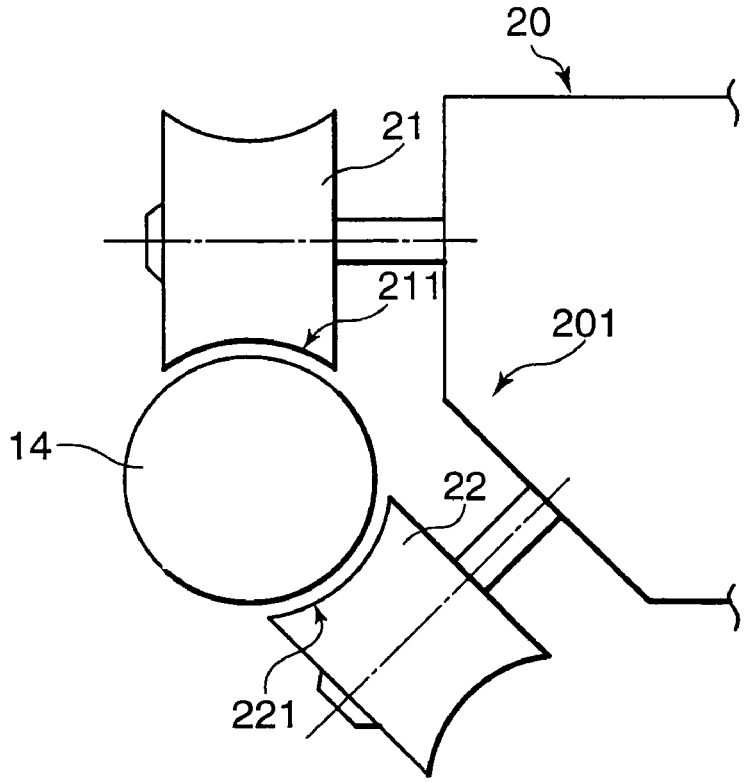
FIG. 4 is a side view of a base stand and a slide base portion, showing their connection structure.
Figure 5:
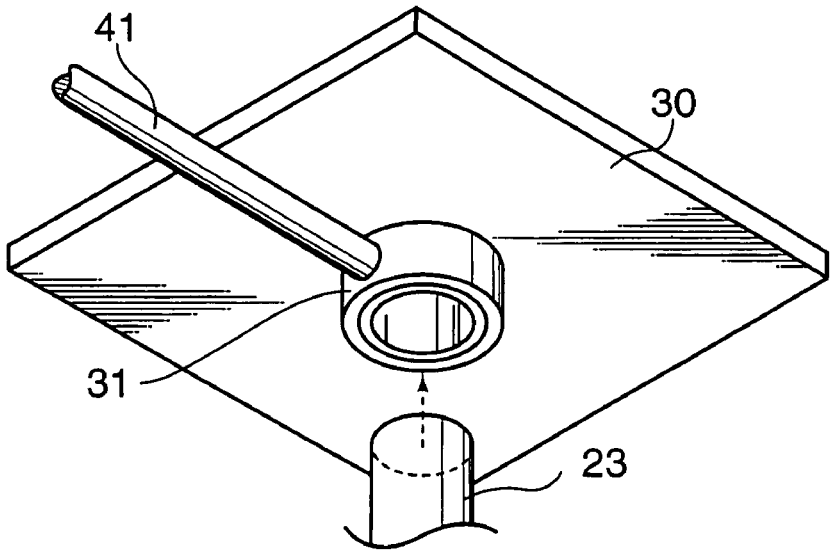
FIG. 5 is a perspective view of the foot-stand portion and a connection mechanism portion, seen from the bottom, showing their connection structure.

Sequentially, a detailed structure of the training apparatus 1 will be described using FIG. 2 to FIG. 5. Herein, FIG. 4 is a side view of the base stand 10 and the slide base portion 20, showing their connection structure. FIG. 5 is a perspective view of the foot-stand portion 30 and the connection mechanism portion 40, seen from the bottom, showing their connection structure.

The base stand 10 includes: a pair of right and left outer frames 11; two bridging beams 12 which connect the right and left outer frames 11; a middle beam 13 in the middle position in the right-and-left directions which reinforces the bridging beams 12; two parallel slide shafts (i.e., the guide rails) 14 which stretch between the right and left outer frames 11; and a stopper 15 which protrudes inward from each outer frame 11.

The base stand 10 has, as its basic structure, a quadrilateral framework which is formed by the pair of long right and left outer frames 11 and the front and rear bridging beams 12. The slide shaft 14 is a rod-shaped body (i.e., according to this embodiment, a pole whose sectional shape is circular) which has a required length and a predetermined-shape section. It is attached at both its ends to the right and left outer frames 11, and the slide shafts 14 are placed side by side a predetermined distance apart from each other in the right-and-left directions of the outer frames 11. The slide shaft 14 functions as a rail (or stay) which guides the slide base portion 20 so that it can be slid. The stopper 15 is made of elastic material such as rubber and is placed to protrude. It is used to lighten an impact which is applied at the time when the slide base portion 20 has bumped against the outer frames 11 if the slide base portion 20 slides in the right-and-left directions.

The slide base portion 20 is a quadrilateral plate-shaped body which is made of a rigid and durable metal or the like. It has a side wall which is formed by bending each end side of the slide base portion 20 downward by a required dimension. To the front and rear side walls of these side walls, two pairs of rollers which are each made up of an upper roller 21 and a lower roller 22 are each attached in the right-and-left directions. As shown in FIG. 4, the upper roller 21 and the lower roller 22 have concave surfaces 211, 221, respectively, whose circumferential surfaces each correspond to the curvature of the slide guide 14. They are each in contact, over the whole circumferential surface, with the slide guide 14. Thereby, the upper roller 21 and the lower roller 22 certainly hold the slide guide 14 at least in the up-and-down directions.

Furthermore, as shown in FIG. 4, the upper roller 21 is supported, via its shaft, to a side wall 201 of the slide base portion 20, around the horizontal axis which is shown by a chain line. On the other hand, the support shaft of the lower roller 22 is supported to the side wall 201 so that it is directed downward at an angle less than 45 degrees to the horizontal direction, or in an inclined direction. Herein, the lower rollers 22 which are provided in the front and rear side walls 201 are inclined in the directions opposite to each other. In other words, the front and rear lower rollers 22 forms a V-letter shape whose middle part is separated. Thereby, the slide base portion 20 is effectively prevented from being released from the slide guide 14. Besides, the width in the up-and-down directions (i.e., the width in the height directions) of the side wall 201 in the slide base portion 20 becomes shorter than the width thereof in the up-and-down directions in the case where the lower roller 22 is horizontally supported (i.e., the lower roller 22 is supported via its horizontal shaft). Therefore, the slide base portion 20 becomes compact in the up-and-down directions, the foot-stand portion 30 which is placed over the slide base portion 20 is brought to a lower position, thereby a player can make a playing motion in as low a position as possible, and in addition, he can easily get on and off a playing position (i.e., the foot-stand portion 30).

Herein, the number of pairs of rollers which are each made up of the upper roller 21 and the lower roller 22 may also be, instead of two, three for the single slide guide 14. In short, a predetermined number of pairs of rollers may also be used, as long as the posture and stable sliding of the slide base portion 20 can be secured. In addition, as described above, the lower roller 22 may also be supported via its horizontal shaft.

The foot-stand portion 30 is a plate-shaped body which is substantially quadrilateral in top view, and has something like a tray on its upper surface. Besides, as shown in FIG. 5, a cylindrical body 31 protrudes in the center of the bottom surface of the foot-stand portion 30. On the other hand, in the center of the upper surface of the slide base portion 20, a columnar body 23 protrudes which has a diametrical dimension at which it fits into the cylindrical body 31 so as to be movable. The columnar body 23 is inserted into the cylindrical body 31, and thereby, the foot-stand portion 30 is supported to the slide base portion 20 so that it can turn. Herein, preferably, the cylindrical body 31 should be a bearing, so that the foot-stand portion 30 can be smoothly turned.

The connection mechanism portion 40 is the part which engages a substantially-middle suitable part of the base stand 10 in the right-and-left directions and the foot-stand portion 30. It is configured by a rod 41 as the swaying arm and a swaying-arm support portion 42. The rod 41 is a pole-shaped body which has a predetermined length and a circular section. It is connected, at one of its ends (i.e., at its base end), to the periphery of the cylindrical body 31. The swaying-arm support portion 42 is put in the middle position of the bridging beam 12 in the right-and-left directions. It is configured by: a horizontal base 421 which protrudes ahead of the bridging beam 12; a support 422 which stands on the horizontal base 421; a turning member 423 which is provided in the support 422 so as to turn freely; and a roller 424 which is supported by each of a plurality of upright shafts that are placed on the turning member 423.

The roller 424 is made up of two pairs of rollers in all. Such a pair of rollers is placed a predetermined distance, or the diameter of the rod 41, apart from each other in the right-and-left directions. The two pairs of rollers are placed close to the front and rear around the turning shaft of the turning member 421. The roller 424 supports the rod 41 such that these two pairs of rollers in total hold the rod 41 between each pair of rollers. In this embodiment, the roller 424 has, at its circumferential surface, a concave surface whose curvature is the same as that of the rod 41. Thereby, it comes into contact, at its entire circumferential surface, with the rod 41. According to this configuration, when the foot-stand portion 30 (i.e., the slide base portion 20) slides in the right-and-left directions, the rod 41 turns around the turning shaft of the turning member 423. In addition, the distance between the columnar body 23 of the foot-stand portion 30 and the turning member 423 changes when the foot-stand portion 30 slides in the right-and-left directions. This change in the distance between the columnar body 23 of the foot-stand portion 30 and the turning member 423 is absorbed, on the tip-end side of the rod 41, by its rubbing according to the change in the distance, in a state where the rod 41 is held, as described above, by the pairs of rollers which are made up of the several rollers 424. Thereby, the foot-stand portion 30 can be slid in the right-and-left directions.

The force giving portion 50 is an elastic body such as a spring. One end of the force giving portion 50 is hooked, by means of hooking fittings (not shown), on the front part of the slide base portion 20, and the other end is hooked, by means of hooking fittings (not shown), on the rear part of the middle beam 13. Thereby, the force giving portion 50 is stretched between the slide base portion 20 and the base stand 10. Herein, in this embodiment, the force giving portion 50 is configured by providing two springs 51, 52 side by side. However, their number may also be one, or three. The force giving portion 50 functions so as to give, in an opened state, the force by which the slide base portion 20 returns to the middle position in the right-and-left directions. In other words, it works so as to give a predetermined load to a player at the time when he has slid in the right-and-left directions.

Herein, in FIG. 3, the force giving portion 50 is hooked in a position close to the slide shaft 14 on the back side. However, it may also be hooked in any positions, as long as the foot-stand portion 30 can be forced toward the middle part. For example, it may also be hooked in a position close to the slide shaft 14 on the front side.

The handrail portion 60 is formed by a rod-shaped body, such as a pipe, which has a diameter at which a player can grasp it. It rises upright from the rear part of the right and left outer frames 11, is bent in the height position of a player's elbows, and has a horizontal portion which spans the right and the left. The right and left upright parts are each connected to a reinforcement pipe which rises upright from the front part of the outer frames 11.

The guide portion 70, as shown in FIG. 1, includes: a tall main-body portion 71; a monitor 72 which is placed at the upper part of the main-body portion 71 and displays a predetermined image, for example, an image for training; and a speaker 73; as well as a sensor 74 such as an infrared sensor which is provided in the middle position in the height directions and detects remotely the right-and-left position of the foot-stand portion 30 (i.e., the slide base portion 20). In addition, the guide portion 70 includes a receiving portion 75 which receives a command signal from the controller 80 (described later).

The controller 80 is used to input predetermined information, such as personal information and operation instructions. It is attached in a predetermined position, for example, in a substantially middle position of the handrail portion 60. The controller 80 includes: a ten-key unit 81 which is provided with buttons for inputting a predetermined word (e.g., "START"), a numeral, or the like; a receiving portion 82 for receiving a predetermined signal from a transmitter or the like; and a transmission portion 83 which transmits a predetermined instruction signal or the like to the receiving portion 75 of the guide portion 70.

Herein, if a player brings, close to the receiving portion 82, for example, a ring (not shown) with a transponder TP (or a transmitter; refer to FIG. 7) which is put on his arm or the like (or if he puts the ring over the receiving portion 82), then it receives a signal which is transmitted from the transponder TP. In addition, the receiving portion 75 and the transmission portion 83 may also be linked, either by wire or by radio.

With respect to the above described configuration, next, an operation of the training apparatus 1 will be described. If the foot-stand portion 30 is moved, from the middle position in its neutral state, in the right-and-left directions, for example, leftward (i.e., in the direction of an arrow A) so that its state shifts from the state shown in FIG. 3A to the state shown in FIG. 3B, then the slide base portion 20 moves leftward along the slide shaft 14. At this time, the base-end side of the rod 41 is fixed to the foot-stand portion 30. On the other hand, by using the roller 424, the other-end side of the rod 41 is the fulcrum of its turning, and it can be rubbed and moved. Therefore, the rod 41 is swayed around the center of the roller 424, in other words, around the turning axis of the turning member 423. In this case, the foot-stand portion 30 turns by the angle which corresponds to the distance by which the rod 41 sways. Specifically, the swaying distance of the rod 41 corresponds to the distance by which the foot-stand portion 30 slides. Thereby, the foot-stand portion 30 turns so that the distance by which it moves in the right-and-left directions from its middle position corresponds to the turning angle of the foot-stand portion 30.

Figure 6:
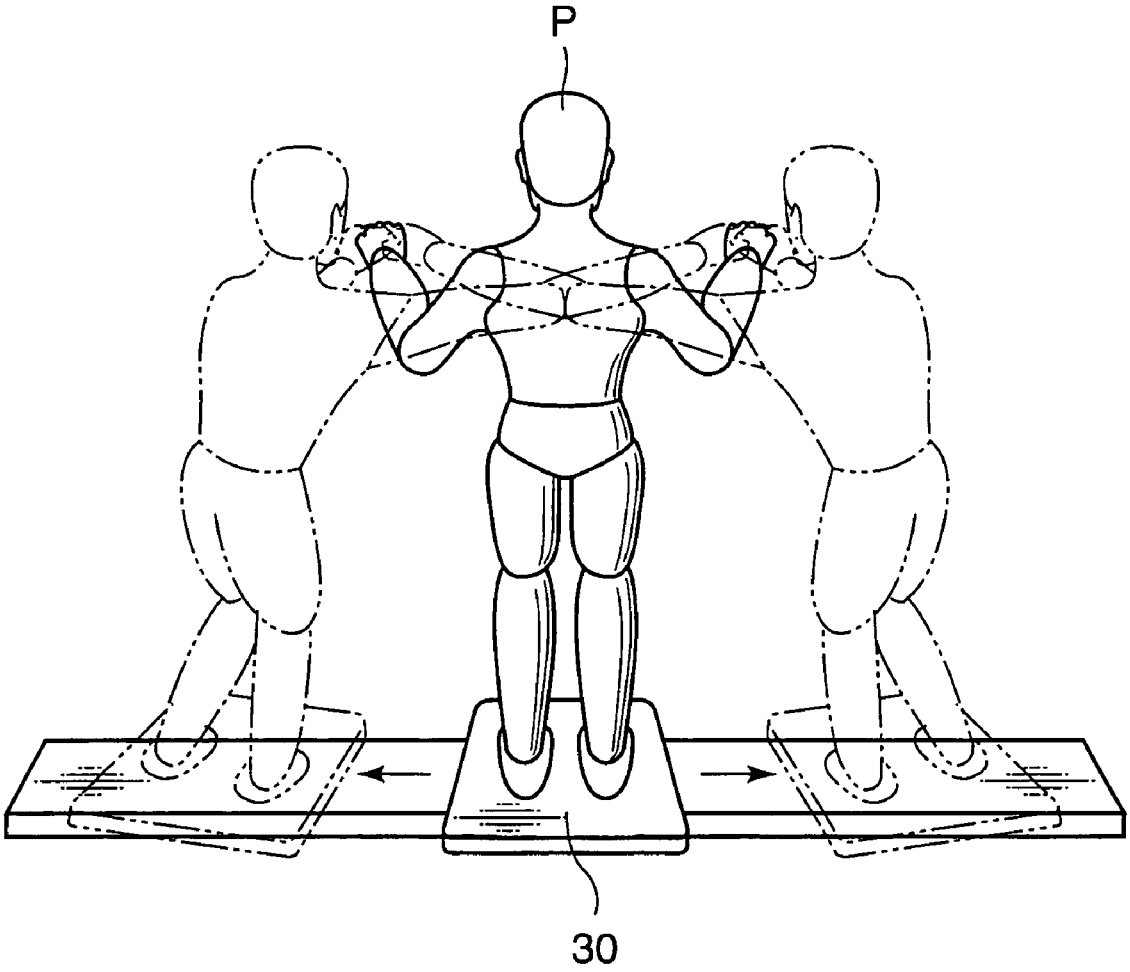
FIG. 6 is a perspective view of the training apparatus and a player, seen from the back, showing an example of a training motion.

As described above, as the slide base portion 20 is slid, the foot-stand portion 30 turns. Thereby, a player on the foot-stand portion 30 can twist his body while sliding. In other words, as can be seen in an example of a training motion shown in FIG. 6, a player P can make a twisting motion, together with a sliding motion. These motions can give exercise to every part of the body, which has been impossible in conventional training apparatus where only a part of the body, such as the leg, can be trained. Furthermore, in the training apparatus according to the present invention, using a sliding motion and a twisting motion, you can take exercise in a state where you keep your body's balance (or posture) properly lost (i.e., without losing the balance of your whole body largely). Thereby, you can effectively train not only your body's lower half (i.e., lower limbs) which centers on your legs and waist, but also your body trunk.

Moreover, when a player returns to the middle position from the state where he has slid, using the force applied by the force giving portion 50, he can easily make the motion continuously. In addition, the handrail portion 60 is provided, so that you can make, as a natural continuous movement (i.e., smooth movement), the movement of keeping balance during a sliding motion and a twisting motion, or the movement of increasing and reducing the sliding speed by controlling the turning angle of the foot-stand portion 30.

Besides, the forwarder you put your feet on the foot-stand portion 30, the greater force you need to apply, to push the slide base portion 20 (i.e., the foot-stand portion 30) in the lateral (i.e., right-and-left) directions when you want to slide it, and to turn (i.e., twist) the foot-stand portion 30. In contrast, the more backward you put your feet on the foot-stand portion 30, the smaller force is required to push it laterally and turn it. In other words, if you stand on the front part of the foot-stand portion 30, the training load becomes heavy, while if you stand on its rear part, the training load becomes light. Accordingly, in this training apparatus 1, the level of an exercise load which is suitable for an individual can be set, despite its simple structure where no load mechanism is provided by means of a brake, a weight, or the like.

Figure 7:
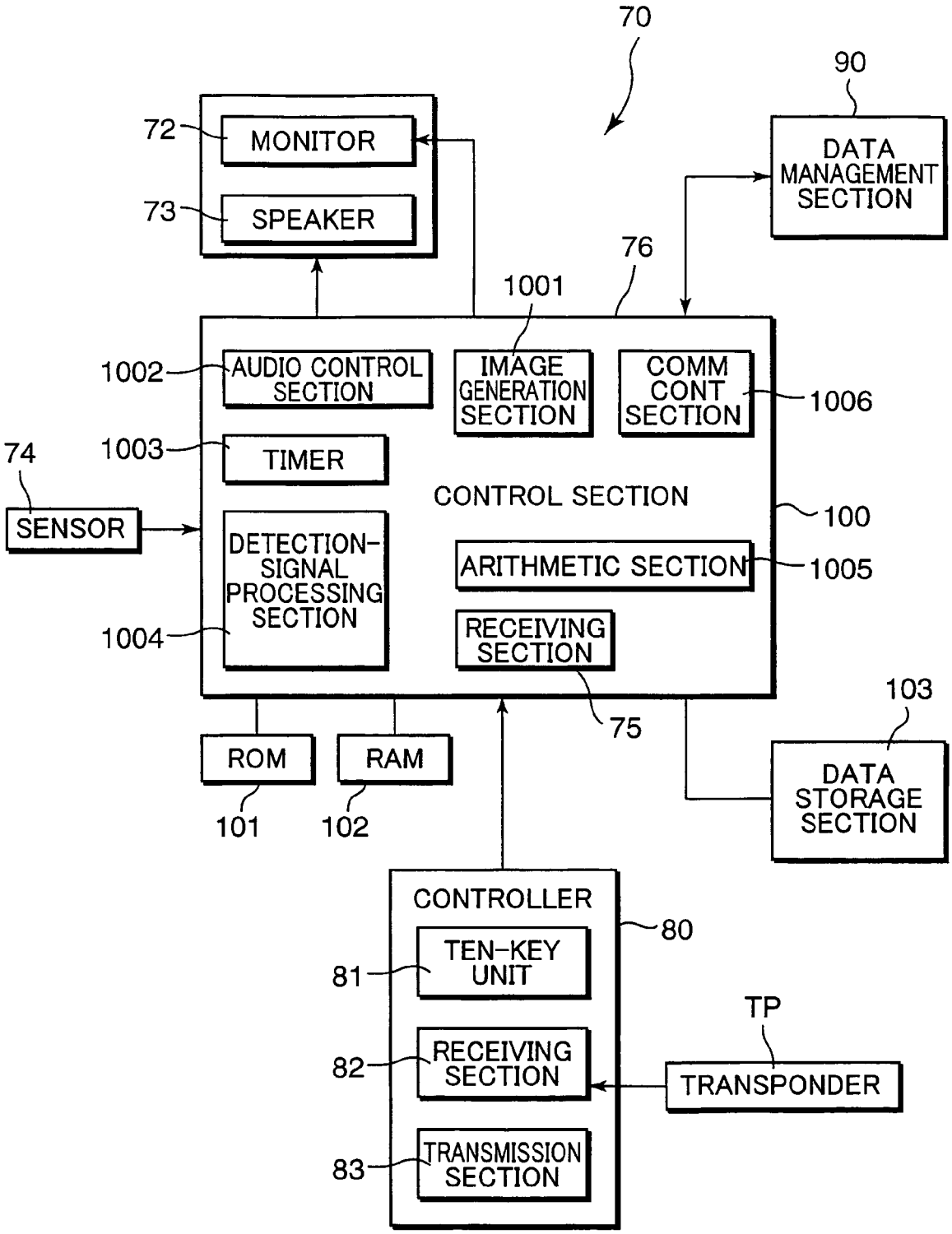
FIG. 7 is a block diagram, showing a control system which executes a training guide in the training apparatus.

FIG. 7 is a block diagram, showing a control system which executes a training guide in the training apparatus 1. A control section 100 includes a CPU for executing overall control of this training apparatus 1. To the control section 100, there are connected: an ROM 101 in which a training control program is stored; an RAM 102 which temporarily stores data whose processing is halfway; and a data storage section 103 which stores image data that is displayed in the monitor 72 and audio data that is sent to the speaker 73.

The control section 100 includes: an image generation section 1001; an audio control section 1002; a timer 1003; a detection-signal processing section 1004; an arithmetic section 1005; and a communication control section 1006. The image generation section 1001 displays, in the monitor 72, images for the registration of a player, the selection of a training mode, and a training guide. The audio control section 1002 sends, to the speaker 73, the sound of background music during an exercise, for example, the sound of a rhythm or the like. The timer 1003 conducts a clocking operation. The detection-signal processing section 1004 generates detection information on the slide base portion 20 or the player P, based on a detection signal from the sensor 74.

The arithmetic section 1005 is a part which calculates training conditions of the player P, based on information from the timer 1003 and the detection-signal processing section 1004, personal information which is inputted from the controller 80, and the like. For example, based upon information on the number of reciprocating motions from the detection-signal processing section 1004, information on a motion speed from the clocking information of the timer 1003, or the personal information of the player P, such as his gender and age, which is transmitted from the transponder TP and is inputted in the controller 71, it calculates the timing of a sliding motion or the operation timing of the foot-stand portion 30, calories which have been consumed in a training, or the like.

The communication control section 1006 communicates with a data management section 90 which is provided in a predetermined position (e.g., in a management room or within a server through a network circuit) outside of the training apparatus 1. The data management section 90 manages data on personal information, such as an identification number (i.e., a membership number) among a plurality of people, for example, in a training membership, and a training record. Based on information which is obtained in the control section 100 and is transmitted from the communication control section 1006, it authenticates an individual, and if necessary, sends a reply.

Figure 8:
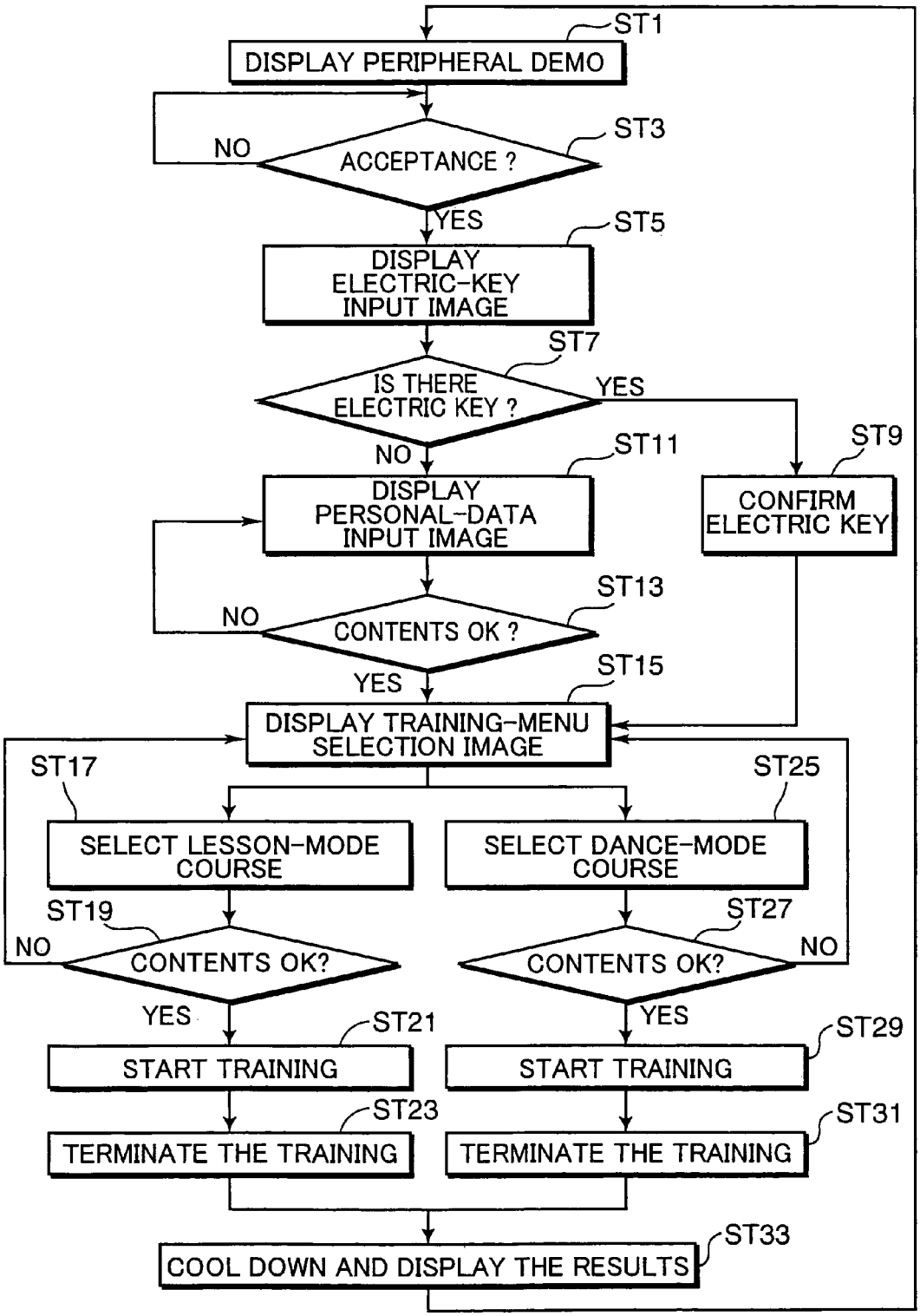
FIG. 8 is a flow chart, showing a display processing to a monitor.

FIG. 8 is a flow chart, showing a display processing to the monitor 72. At the ordinary time, in the monitor 72, there is displayed a series of images which is displayed at the time of a training as a demonstration (or peripheral demo) image (in a step ST1). Even while this demonstration image is being displayed, an instruction to prompt training, such as "Press the start button", remains on display in a part of the screen of the monitor 72. Then, if the player P gets on the foot-stand portion 30 and presses a "START" key of the controller 80 according to this instruction to "Press the start button" (YES at a step ST3), then the image is switched from the standby image to an electronic-key input image which displays a message that "if you have an electronic key, bring it over the ten key", or the like (in a step ST5). Unless the "START" key is pressed (NO at the step ST3), the image of the standby state is kept displayed.

Herein, in the case where the player P has an electronic key (YES at a step ST7), if the player P puts, over the receiving portion 82, the electronic key such as a ring with the transponder TP, then his personal information from the transponder TP is taken into the control section 100. Then, based on this taken-in personal information, the control section 100 communicates, via the communication control section 1006, with the data management section 90, and authenticates the player P (i.e., confirms the electronic key) (in a step ST9).

Herein, an electronic key can be inputted only in the timing when such a message as described above has been displayed, such as "if you have an electronic key, bring it over the ten key." Afterward, such an input will not be accepted, even if you places the electronic key, for example, by mistake, over the controller 71 while being exercising.

In the case where the player P does not have any electronic key (NO at the step ST7), a personal-data input image is displayed in the monitor 72. According to the guide of this image, the player P inputs his personal information, using the ten-key unit 81 of the controller 80 (in a step ST11). At this time, in the same way as the case where an electronic key is used, the control section 100 communicates, via the communication control section 1006, with the data management section 90, and authenticates the player P (i.e., confirms the electronic key) (in a step ST13).

Figure 9A:
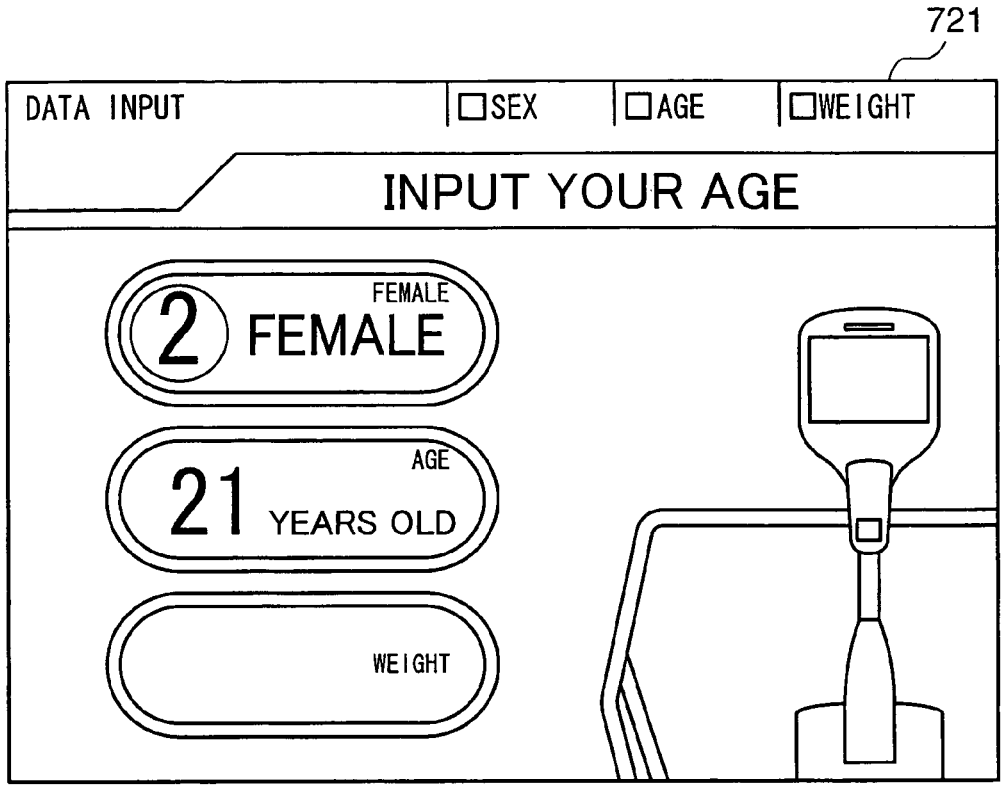
FIG. 9A is a representation, showing an age input image on a personal-information input image which is displayed on a monitor screen.
Figure 9B:
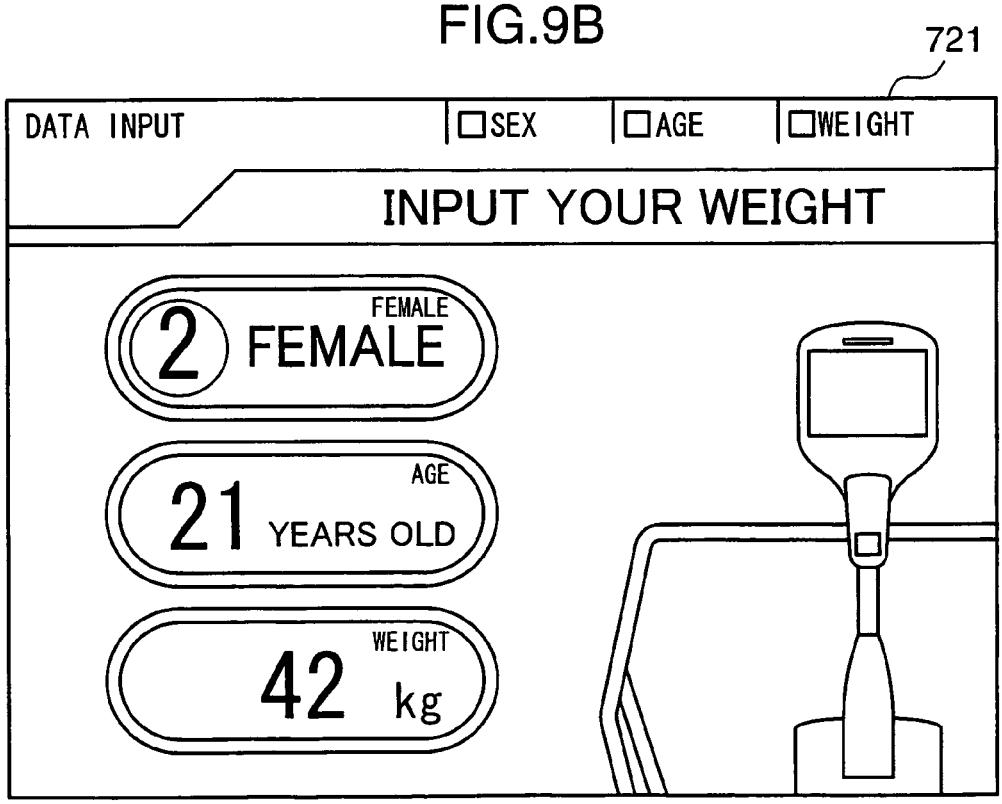
FIG. 9B is a representation, showing a body-weight input image on the personal-information input image which is displayed on the monitor screen.

Herein, FIG. 9 shows a personal-information (or personal-data) input images which are displayed on a monitor screen 721. When personal information is inputted using the ten-key unit 81 of the controller 80, a message is displayed, for example, "Input your age", as shown by an age input image in FIG. 9A, "Input your weight", as shown by a body-weight input image in FIG. 9B, or the like. According to such a guide, the player P inputs his personal information, such as his gender, age and weight, one after another. Then, the player P confirms the contents of the personal information which he has inputted. If he wants to correct the contents (NO at the step ST13), the processing returns to the step ST11 and he inputs it again. If he confirms that the contents of the personal information are correct (YES at the step ST13), the processing goes ahead to the next step ST15.

Figure 10A:
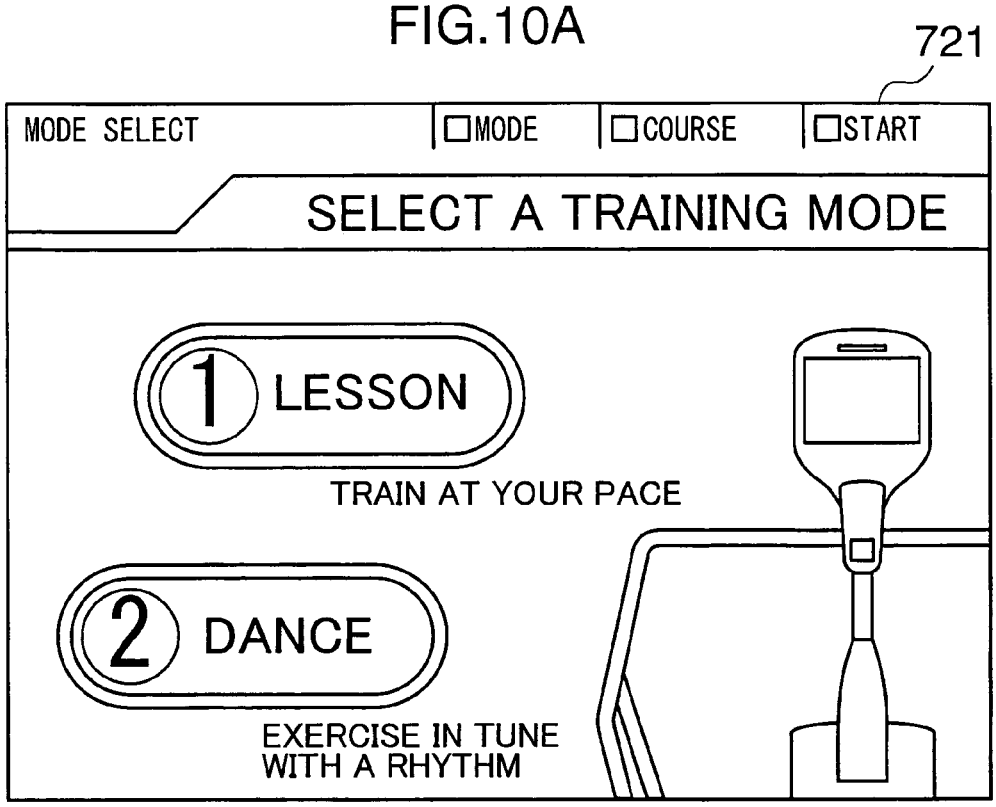
FIG. 10A is a representation, showing a training-menu selection image on a training-content selection image.

FIG. 10 shows a training-content selection images. As described above, if the individual has been authenticated based on the personal information which was inputted using the electronic key or the ten key, then, for example, as shown FIG. 10A, a training-menu selection image which shows a message, such as "Select a training mode," is displayed on the monitor screen 721 (in a step ST15). Using the training-menu selection image, you can select, for example, a lesson mode (No. 1) in which you can train at your own pace, or a dance mode (No.2) in which you can exercise in tune with a rhythm (or rhythmic music) or the like from the speaker 73.

Figure 10B:
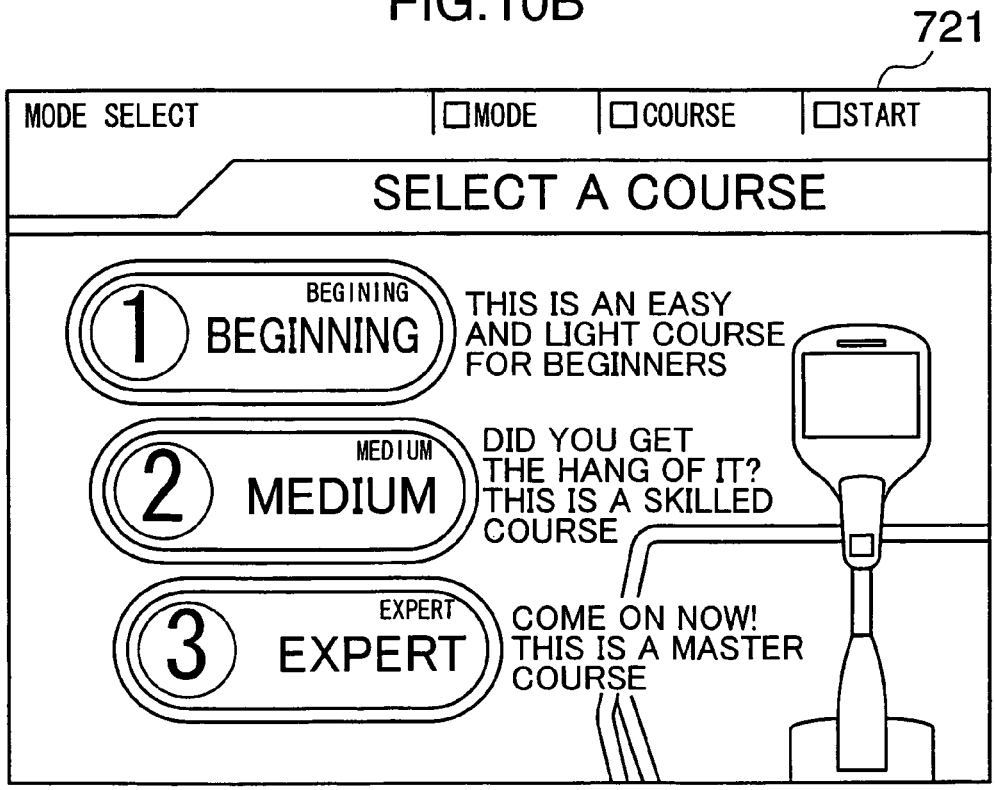
FIG. 10B is a representation, showing a course selection image on the training-content selection image.

If you select the training mode of No. 1 or No. 2 (in a step ST17, a step ST25), for example, as shown FIG. 10B, a course selection image which shows a message, such as "Select a course," is displayed on the monitor screen 721. In this course selection image, selection courses are displayed, for example, beginning (No. 1), medium (No. 2), and expert (No. 3). Thereby, you can select your favorite course (a lesson menu in each mode) among those. Next, the player P confirms the contents which he has inputted (or selected). If he wants to correct the contents (NO at a step ST19, NO at a step ST27), the processing returns to the step ST15. If he confirms that the contents are correct (YES at the step ST19, YES at the step ST27), the training apparatus 1 starts a training operation (in a step ST21, a step ST29).

Figure 11:
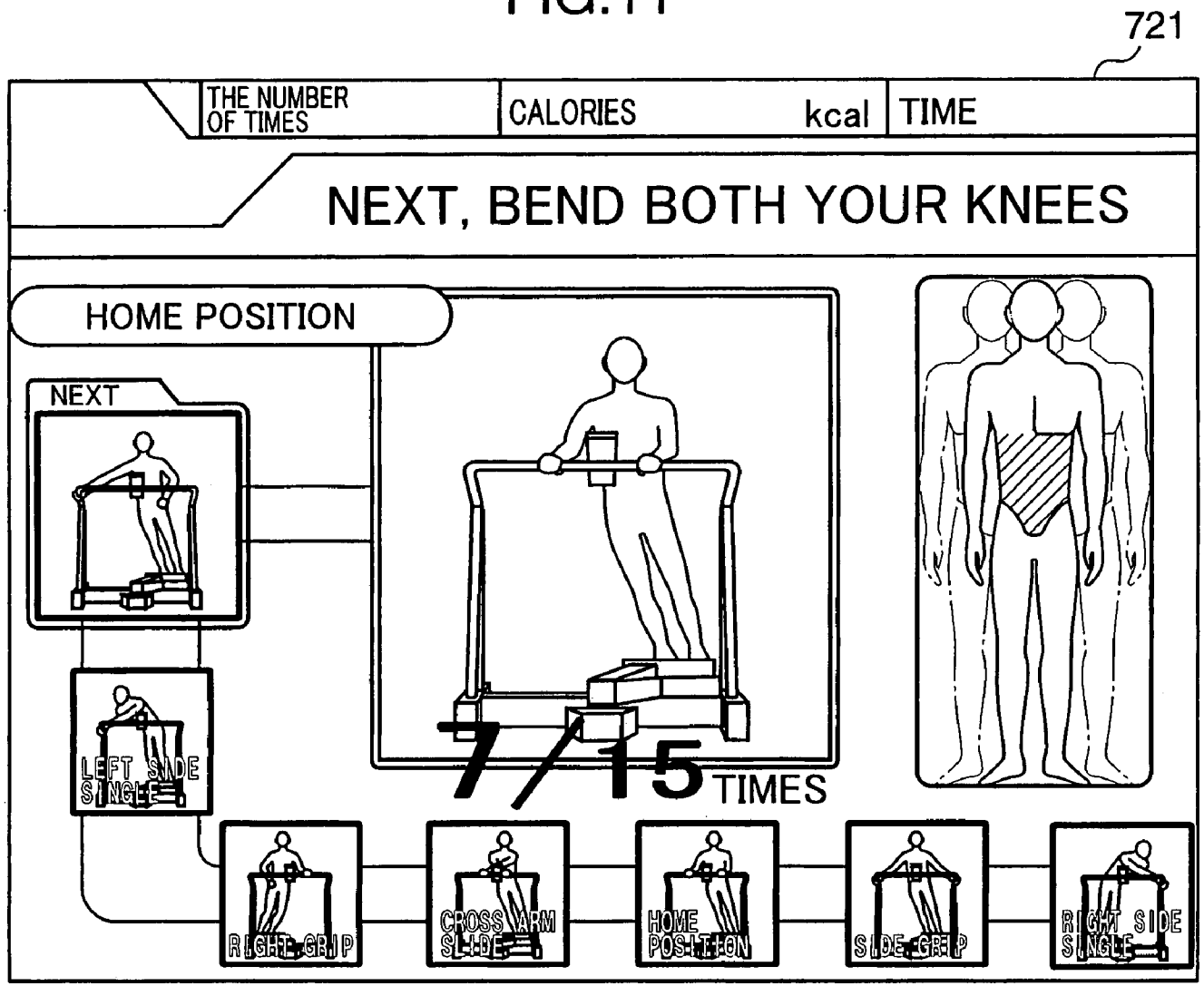
FIG. 11 is a representation, showing an example of a lesson image in the case where a lesson mode has been selected.
Figure 12:
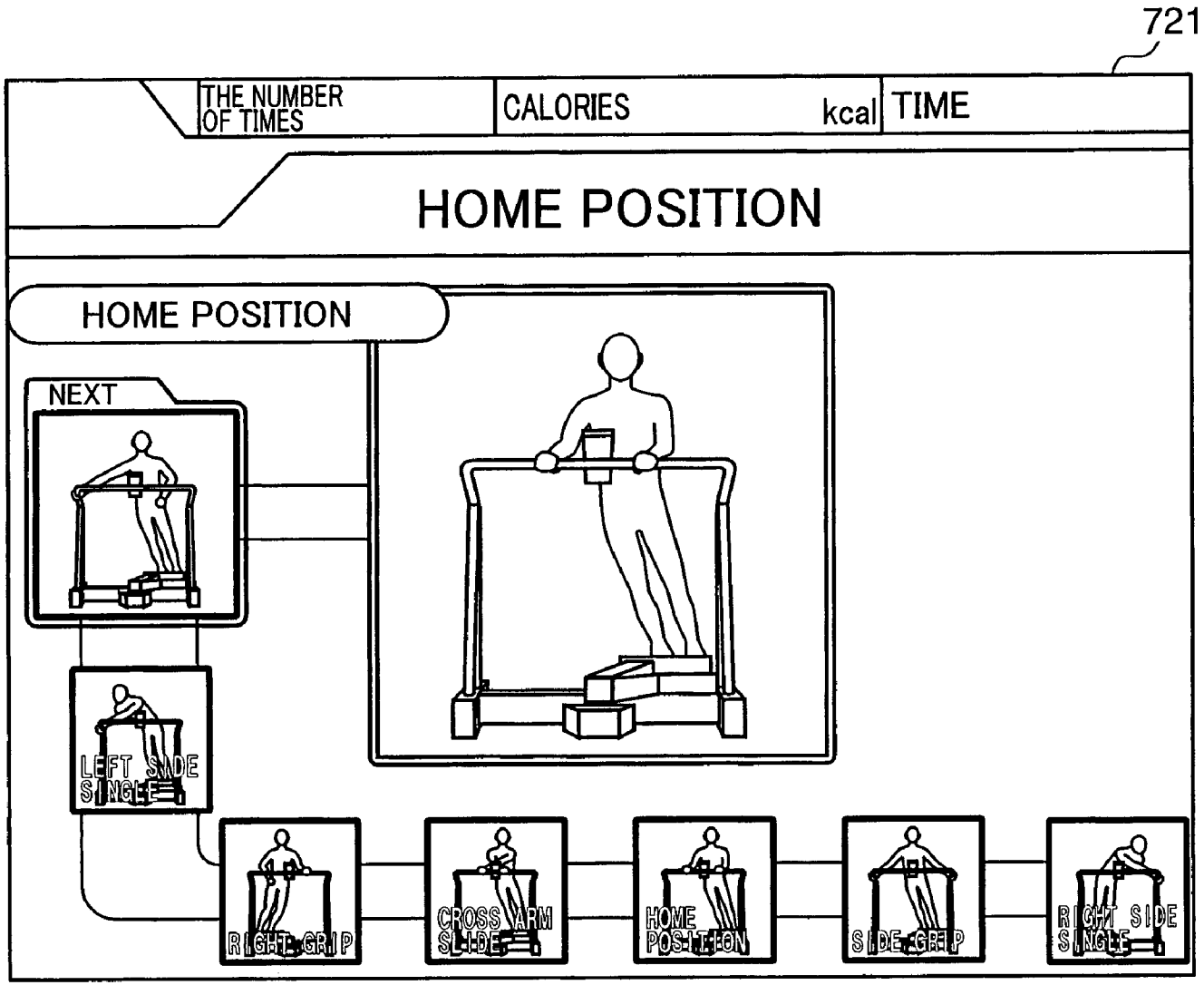
FIG. 12 is a representation, showing an example of a dance image in the case where a dance mode has been selected.

Herein, FIG. 11 and FIG. 12 show each training-mode image which is displayed on the monitor screen 721 during a training operation. FIG. 11 shows an example of a lesson image in the case where a lesson mode has been selected. There are several types of lessons according to how you grasp the handrail portion 60 while training (e.g., a training which you do with gripping on it in only one hand, or a training which you do with holding onto it in your hands while narrowing the distance between your arms), or the like. Those lessons are called mini-lessons. In the lower part of the lesson image, there are displayed mini-lesson symbol characters which each express a typical training posture (or pose) so that you can distinguish between the mini-lessons. At and near the central part of the lesson image, there is displayed a movie (i.e., a motion confirmation movie) for confirming the motion of a mini-lesson which is made at present. In other words, near the central part of the lesson image, mini-lesson symbol characters are displayed together with the motion which corresponds to each mini-lesson.

On the left side of this motion-confirmation movie display portion, there is displayed the name (i.e., the name of a posture) of a mini-lesson which is currently made. Besides, on the left side of the image, a movie (i.e., a next-motion confirmation mini-movie) is displayed for confirming the motion of the next lesson. In the middle part (i.e., a portion which displays the number of times) of the image, there is displayed the number of times (i.e., the current number of times/the set number of times) up to which you have repeated each mini-lesson. In the upper part of the image, a message is displayed one after another which shows a training motion, such as "Next, bend both your knees." In addition, the right part of the image, a muscle part on which you should concentrate your attention while training, or the like, is displayed so that you can discern it. For example, the illustration of a human body (i.e., the illustration of human-body muscles) is displayed by expressing such a part with a different color. Besides, the top part of the image, there are displayed the repetition number of times which is counted from the time when a training started, consumed calories (kcal), the time which has elapsed since the training's start, and the like.

FIG. 12 shows an example of a dance image in the case where the above described dance mode has been selected. The image on the monitor screen 721 shown in FIG. 12 has the same configuration as that of the image on the monitor screen 721 shown in FIG. 11. Hence, an image similar to the above described lesson mode is displayed. Herein, such a human-body illustration or number-of-times display portion as described above is not displayed, however, those may also be displayed. In this dance mode (i.e., the dance image), a mini-lesson makes progress along with a tune (or rhythmic music). Thus, in order to make you recognize a shift to each mini-lesson image in the above described motion confirmation movie, for example, the count of "3, 2, 1, 0", or the like, may also be displayed largely and conspicuously in the image of this motion confirmation movie.

After the player P has completed the whole training (i.e.,mini-lessons) according to the contents of instructions in each training-mode image of FIG. 11 and FIG. 12, or if he wants to call off the training, he presses an ending button which is provided in the controller 80, a ring with the transponder TP that is fitted into his arm, or the like. Thereby, a termination signal is transmitted to the control section 100 (in a step ST23, a step ST31). The control section 100 which has received this termination signal allows the image generation section 1001, the audio control section 1002, or the arithmetic section 1005, to execute the operation of terminating the training, such as so-called cooling-down and the display of results (in a step ST33). Specifically, the control section 100 allows the image generation section 1001 to display a message, such as "The training will end," on the monitor screen 721. Thereafter, it allows it to display an instruction to make a natural lateral motion which gives the lightest load, for example, a message, such as "Stand backward on the foot-stand portion 30 and slide slowly." Besides, it allows the audio control section 1002 to execute an termination operation, such as gradually slowing down the tempo of a rhythm which is produced by the speaker 73. This termination operation is aimed at lightening the burden imposed on the player P's body when he stops exercising in no time.

In addition, during this termination operation, the control section 100 directs the arithmetic section 1005 to put together and calculate the training results. For example, as described above, based on information from the timer 1003 or the detection-signal processing section 1004, the arithmetic section 1005 the number of times up to which a sliding motion (or a twisting motion) was repeated, the time which elapsed (or was taken) from the beginning to the end of the training, the number of times up to which the operation timing coincided, total consumed calories, and the like. Then, their results are displayed on the monitor screen 721.

Herein, at the time of the training (i.e., mini-lesson) before the termination operation is executed (in the step ST21, the step ST29), the control section 100 displays and controls, in the same way, the repetition number of times (i.e., the current number of times/the set number of times), the consumed calories, the time which elapsed from the beginning of the training, and the like, which are shown in each mode image of FIGS. 11, 12.

As described above, the training apparatus 1 is configured so that a training menu, such as a mode and a course, can be selected, and the results of a training can be displayed in the monitor 72. Therefore, the player P can clarify the goal of a training, and at the same time, deepens his understanding of how to exercise (i.e., how to use the training apparatus 1), or how to train effectively. In addition, using the contents which are displayed in the monitor 72, specifically, using not only the above described training displays, but also, for example, the display of an amusement image, such as a game and a television, other than the training displays, the player P can enjoy himself at the training time which tends to be monotonous and tedious.

Figure 13:
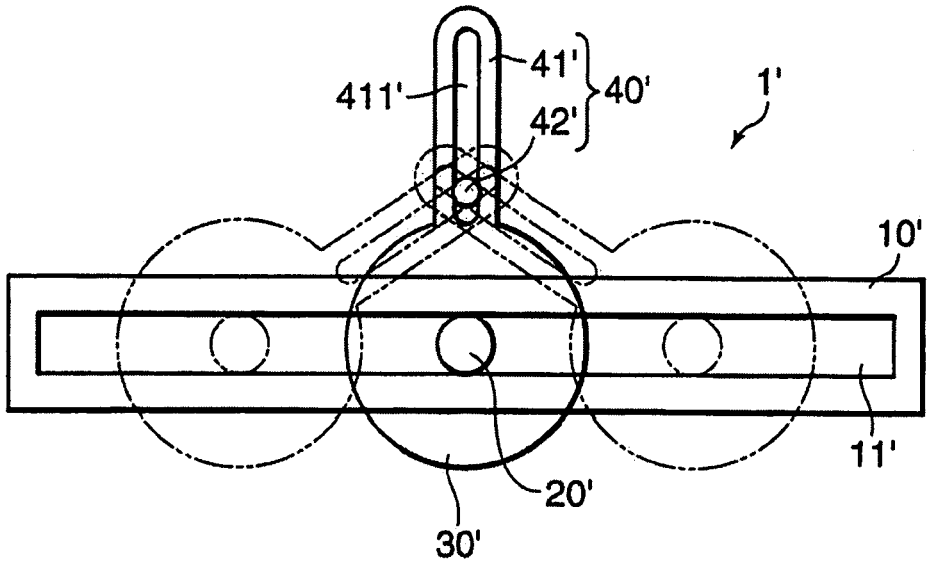
FIG. 13 is a schematic top view of a variation of the training apparatus, showing its configuration.
Figure 14A:
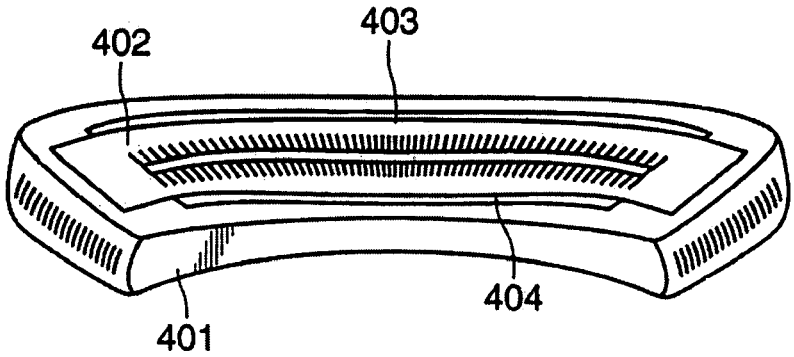
FIG.14A PRIOR ART
FIG. 14A is a perspective view of conventional training apparatus.
Figure 14B:
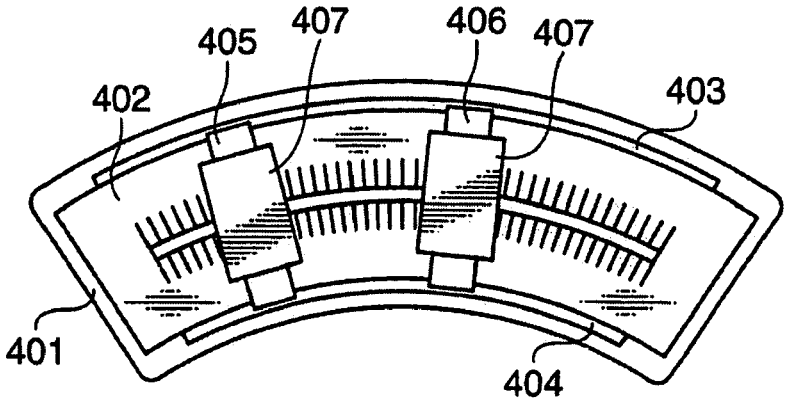
FIG.14B PRIOR ART
FIG. 14B is a plan view of the conventional training apparatus.
Figure 15:
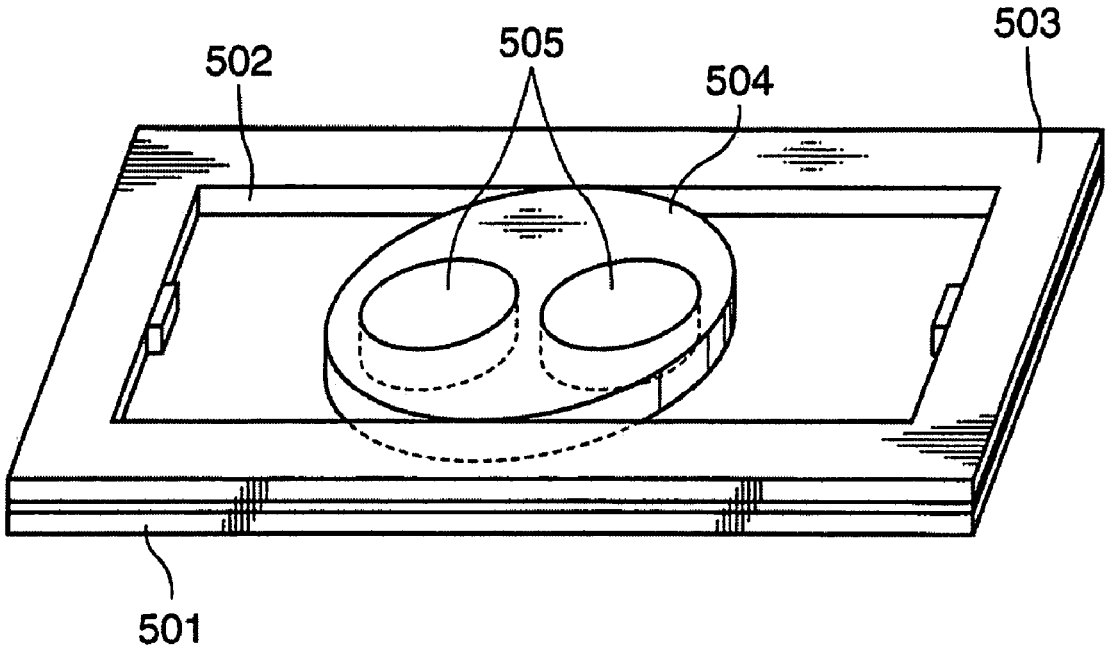
FIG.15 PRIOR ART
FIG. 15 is a perspective view of other conventional training apparatus.

FIG. 13 is a schematic top view of a variation of the training apparatus, showing its configuration. A configuration portion 1' according to this variation includes: a base stand 10'; a slide base portion 20'; a foot-stand portion 30'; and a connection portion 40'. The base stand 10' is a plate-shaped body which extends right and left and has a required width and a required thickness. The base stand 10' has, on its inside, a long hole 11' which has a required width and extends in its longitudinal directions. The slide base portion 20' is a columnar body and has a diameter which corresponds to the width of the long hole 11'. It is fitted into this long hole 11' so as to be movable. To the top surface of the columnar body 20', the foot-stand portion 30' which has a predetermined shape, for example, a disk shape, is attached so as to have the same turning center as that of the columnar body 20'. The slide base portion 20' and the foot-stand portion 30' may have a structure in which they can turn together, and they may also have a structure in which they can turn relatively.

At a proper place in the side part of the foot-stand portion 30', an arm 41' is provided which extends radially from the center of the foot-stand portion 30' and has a required width. Ahead of the middle of the base stand 10', a columnar swaying shaft 42' is provided which has a required diameter. The arm 41' has, on its inside, a long hole 411' which, over its longitudinal directions, has a width which corresponds to the swaying shaft 42'. The swaying shaft 42' is fitted into this long hole 411'. Herein, a force giving portion may be hooked on and stretched between the base stand 10' and the slide base portion 20', in the same way as the above described embodiment. Even according to this configuration, a sliding motion and a twisting motion can be made together.

The training apparatus 1 according to the present invention is characterized by including the following component elements: a base stand which has a guide rail that extends in the right-and-left directions; a slide base portion which can slide along the guide rail; a foot stand which is provided over the slide base portion so as to be turned; a connection means which engages a substantially-middle proper part of the base stand in the right-and-left directions and the foot stand, so that the sliding position and the turning angle of the foot stand can be related; and a force giving means which gives the slide base portion the force by which the slide base portion moves toward a substantially-middle position of the base stand in the right-and-left directions.

In the above described training apparatus 1, preferably, the connection means should have: a swaying arm one end of which is connected to the foot stand; and a swaying-arm support portion which is provided in the base stand and supports the side of the other end of this swaying arm so that the other-end side can turn and rub freely. According to this configuration, using the swaying arm as the arm for a swaying motion and the swaying-arm support portion as the turning center (or shaft), a turning motion of the foot stand can be made together with a sliding motion.

Furthermore, it is preferable that the swaying arm be formed by a rod-shaped body, and the swaying-arm support portion have a pair of rollers which holds the rod-shaped body between the rollers. According to this configuration, the swaying arm can have a simple structure. Besides, the swaying arm has a swaying center in the position where it is held between the pair of rollers, and it rubs and moves. Thereby, its swaying motion can be realized.

Moreover, it is preferable that as the guide rail, two guide rails be provided side by side, and the slide base portion hold, at both ends thereof in the front-and-rear directions, each guide rail. According to this configuration, the slide base portion can slide stably.

In addition, it is preferable that the slide base portion have a pair of rollers which holds the guide rail between the rollers in the up-and-down directions. According to this configuration, the slide base portion can be prevented from coming off the guide rail.

Furthermore, it is preferable that among the pair of rollers which holds the guide rail between the rollers in the up-and-down directions, the axis of the upper roller be horizontal, and the axis of the lower roller be inclined. According to this configuration, the lower roller is supported via its shaft to the slide base portion, in a higher position than in the case where it has a horizontal shaft. Therefore, the slide base portion's height dimension can be shortened. Thus, it makes it possible to make the slide base portion compact.

Moreover, it is preferable that the force giving means be a spring which is stretched between the slide base portion and the base stand. According to this configuration, the force giving means becomes a simple structure.

In addition, it is preferable that the base stand have a handrail portion. According to this,configuration, a player can easily start to slide by gripping the handrail portion and thereby keeping both his feet on the foot stand. Besides, a player can easily balance his body while making a sliding motion and a turning motion simultaneously.

Furthermore, the above described training apparatus may further include a monitor which displays an image for a training guide. According to this configuration, using a monitor screen, the training apparatus can offer a player an image for a training guide.

Moreover, the above described training apparatus may further include a controller which gives an instruction to switch the training-guide image that is displayed in the monitor. According to this configuration, using the controller, the training apparatus can offer a desirable training guide to a player.

In addition, it is preferable that the controller be disposed in the handrail portion. According to this configuration, a player can operate the controller in a state where he is on the foot stand.

Herein, the present invention can use the following variations.

(1) The foot-stand portion 30 may also have, in addition to a quadrilateral shape, a circular shape, or a polygonal shape other than a quadrilateral shape. Therefore, for example, the foot-stand portion 30 may also be modeled on a surfboard, a snowboard, or a pair of skis.

(2) The slide shaft 14 and the rod 41 is not necessarily shaped like a straight line. They may also have a bent part, over a part of them, or over their whole part. In addition, the slide shaft 14 and the rod 41 should not necessarily have a circular section. They may also have an elliptical (or eccentric circular) section, or a polygonal, such as rectangular and a square. Besides, the rod 41 and the cylindrical body 31 may also be united. In that case, the peripheral surfaces of the upper roller 21, the lower roller 22 and the roller 424 are each formed to have a shape in which they can come into contact over their entire surfaces as much as possible.

(3) The roller 424 is not necessarily provided on the plane where the slide base portion 20 slides. It may also be located above the foot-stand portion 30. For example, the rod 41 may also be placed upward in the vertical directions to the horizontal plane of the slide base portion 20 (or the foot-stand portion 30). In that case, it makes a swaying motion within the vertical plane, and thus, the dimension in the front-and-rear directions becomes shorter.

(4) The sensor 74 is not necessarily provided in the guide portion 70. It may also be provided, for example, at a proper place of the handrail portion 60, or in the controller 80. In addition, in order to count the number of times up to which a sliding motion has been repeated, for example, a position sensor which is formed by a proximity sensor or a mechanical switch may also be provided at suitable right and left places of the base stand 10. In that case, it detects whether there is the slide base portion 20. Then, the number of times up to which it has been detected is counted, so that the number of the reciprocating motions can be counted up. Or, a position sensor which detects the swaying of the rod 41, or the like, may also be provided at a suitable place of the swaying-arm support portion 42. In that case, it counts up the number of its sways.

(5) A pressure sensor may also be fixed on the foot-stand portion 30, inside of the foot-stand portion 30, or on its bottom surface, so that it can detect a load which is applied on the foot-stand portion 30. Thereby, it detects whether a player stays on the foot-stand portion 30.

(6) The monitor 72 may also be united with the base stand 10, not separated from it. That facilitates the wiring of a signal wire with the controller 80.

(7) Instead of a ring with the transponder TP, or the like, a card in which personal information is recorded, or the like, may also be used. In that case, a card-information reading portion (or a card insertion portion) is provided in the controller 80, or the like. By inserting such a card into this, or by another such operation, the authentication of an individual is conducted.

(8) The following variation may also be adopted. A publicly-known touch-panel sensor which is formed by a transparent body is affixed on the surface of the monitor 72. Inside of the control section 100, there are provided: a means for correlating the coordinates of the position on the screen and the position of the touch-panel sensor, and a means for specifying each button which is displayed on the screen, using the detection coordinates of the touch position. This makes it easy to operate such a controller.

INDUSTRIAL APPLICABILITY

The training apparatus according to the present invention can be used to take a sliding exercise and a twisting exercise together without making a stamping motion or another such motion, and train your body trunk effectively.

The invention claimed is:

1. Training apparatus, comprising:

a base stand which has a guide rail that extends in the right-and-left directions;

a slide base portion which slidably coupled to the guide rail;

a foot stand which is rotatably provided over the slide base portion so as to rotate relative to the base portion;

a connector which engages a substantially-middle part of the base stand in the right-and-left directions and the foot stand, so that the sliding position of the base portion and the turning angle of the foot stand can be correlated, said connector including:

a swaying arm being formed in a rod, one end of said swaying arm being rotatable connected to the foot stand;

a swaying arm support portion provided on the base stand, said swaying arm supported portion including a support member provided on the base stand, said swaying arm support portion further including a turning member which is rotatably provided on said support member, said turning member being provided with a pair of rollers freely rotatable about a vertical axis in such a manner that the other end of said swaying arm is held in between said pair of rollers so that said swaying arm slides therethrough along with movement of the slide base portion along the guide rail; and a force giving device which gives the slide base portion a biasing force by which the slide base portion moves toward a substantially-middle position of the base stand in the right-and-left directions.

2. The training apparatus according to claim 1, wherein the guide rail includes two guide rails provided side by side, and the slide base portion holds, at both ends thereof in the front-and-rear directions, each guide rail.

3. The training apparatus according to claim 1, wherein the slide base portion has a pair of rollers which holds the guide rail between the rollers in the up-and-down directions.

4. The training apparatus according to claim 3, wherein among the pair of rollers which holds the guide rail between the rollers in the up-and-down directions, the axis of the upper roller is horizontal, and the axis of the lower roller is inclined.

5. The training apparatus according to claim 1, wherein the force giving device includes a spring which is stretched between the slide base portion and the base stand.

6. The training apparatus according to claim 1, wherein the base stand has a handrail portion.

7. The training apparatus according to claim 1, comprising a monitor which displays an image for a training guide.

8. The training apparatus according to claim 7, comprising a controller which gives an instruction to switch the training-guide image that is displayed in the monitor.

9. The training apparatus according to claim 8, wherein the controller is disposed in the handrail portion.

10. The training apparatus according to claim 1, wherein:

said foot stand is in a form of a plate and said swaying arm is in a form of a single rod; and said foot stand is operatively connected to said turning member via said single rod.

11. The training apparatus according to claim 10, wherein:

said foot stand is formed with a downwardly projecting member on a bottom side thereof;

said rod is rigidly connected to a side of the downwardly projecting member; and an upwardly projecting member is formed on the slide base portion and said upwardly projecting member is rotatably engaged with the downwardly projecting member.

12. The training apparatus according to claim 11, wherein said downwardly projecting member includes a hollow cylinder member and said upwardly projecting member includes a circular column member such that said column member is pivotably fit into the hollow cylinder member.

* * * * *